US007084359B1

(12) United States Patent
Konno

(10) Patent No.: US 7,084,359 B1
(45) Date of Patent: Aug. 1, 2006

(54) SWITCH DEVICE HAVING RUBBER DOME AND GENERATING SUPERIOR CLICK FEELING

(75) Inventor: Satoru Konno, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/349,579

(22) Filed: Feb. 8, 2006

(30) Foreign Application Priority Data

Feb. 16, 2005 (JP) ..... 2005-039485

(51) Int. Cl.
*H01H 9/00* (2006.01)
*H01H 1/10* (2006.01)

(52) U.S. Cl. ..... 200/1 B; 200/512; 200/517

(58) Field of Classification Search ..... 200/1 B, 200/5 R, 512, 517, 341, 329
See application file for complete search history.

(56) References Cited

U.S. PATENT DOCUMENTS 5,115,108 A * 5/1992 Ogawa et al. ..... 200/1 B
5,693,950 A 12/1997 Stengl et al.
5,719,361 A * 2/1998 Lee ..... 200/1 B
6,437,259 B1 * 8/2002 Geppert et al. ..... 200/5 R
6,653,586 B1 * 11/2003 Hsiung et al. ..... 200/517
6,670,562 B1 * 12/2003 Kaneko ..... 200/1 B
6,737,592 B1 * 5/2004 Hoang et al. ..... 200/1 B

FOREIGN PATENT DOCUMENTS

JP 5-36723 5/1992
JP 7-312145 11/1995
JP A-2002-334631 11/2002

* cited by examiner

*Primary Examiner*—Michael A. Friedhofer
(74) *Attorney, Agent, or Firm*—Brinks Hofer Gilson & Lione

(57) ABSTRACT

A switch device is provided with a first rubber dome for small application force, a second rubber dome for heavy application force, and an operation body. The rubber domes are integrally formed with a plate shaped base, and adjacent to each other. Lower ends of the operation body is disposed on the top surface of the first and second rubber domes. The operation body is movably supported in a vertical direction. The base around the second rubber dome is formed with a smaller thickness than the base around the first rubber dome. A preventing part is provided so as to prevent the base of the first rubber dome from deforming. The thick base around the second rubber dome for and the preventing part are disposed around an outer periphery of the base of the first rubber dome.

3 Claims, 7 Drawing Sheets

SWITCH DEVICE HAVING RUBBER DOME AND GENERATING SUPERIOR CLICK FEELING

BACKGROUND OF THE INVENTION

1. Field of the Invention

The present invention relates to a switch device for use as a power window switch of, for example, an automobile.

2. Description of the Related Art

As an example of a switch device in the related art, JP-A-2002-334631 discloses a power window switch of an automobile, and FIGS. 11 and 12 show the above power window switch.

When a pulling operation is performed on a switch device S2 shown in FIG. 11 by hooking a finger on an operation side wall of a seesaw knob 101 so as to be pulled in an arrow direction indicated by C, the operation side wall 102 of the seesaw knob 101 is pulled, and then a driving member 103 integrally mounted on the seesaw knob 101 moves so as to pivot on a concavity 104 as a fulcrum, thereby pressing a switch operation part 105.

When the switch operation part 105 is pressed, an operation body 106 in contact with the switch operation part 105 and a cam member 108 in contact with a pressed part 107 of the operation body 106 are all pressed. When the cam member 108 is pressed in this way, movable contacts 110 inside two rubber domes 119 of a click rubber 109 are brought in contact with two fixed contacts (not shown) of a printed wiring substrate 111, respectively facing the movable contacts, which leads to becoming the state show in FIG. 12, thereby turning on two of first switches.

Next, when the pulling operation on the operation side wall 102 of the seesaw knob 101 is released from the state of FIG. 12, the movable contacts 110 are separated from the fixed contacts by a resilient force of the rubber dome 119 having the two movable contacts 110, thereby turning off the first switches. At this time, the cam member 108 and the operation body 106 are pushed upward by a resilient force of the rubber dome 119 having the movable contacts 110. with the pushing upward, the driving member 103 pivots on the concavity 104 as a fulcrum, so that the switch operation part 105 is pushed upward, whereby the seesaw knob 101 returns to its original position shown in FIG. 11.

Reference numeral 112 indicates a member for mounting the driving member 103, reference numeral 113 indicates a through hole of the mounting member 112, reference numeral 114 indicates a upper wall of the seesaw knob 101, reference numeral 115 indicates a side wall of the seesaw knob 101, reference numeral 116 indicates an outer peripheral wall of the mounting member 112, reference numeral 117 indicates another switch operation part of the driving member 103, and reference numeral indicates a cover for covering the bottom.

In the switch device according to the related art, since the switch operation parts 105 and 117 should be pressed so as to abut the center of the cam member 108 corresponding to the middle position between the two rubber domes 119, the two rubber domes 119 are concurrently pressed, as shown in FIG. 12, thereby turning the switches on. In the meantime, a recently developed power window switch provides a two-stage operation; a manual operation is performed in a first-stage operation, an automatic operation is performed in a second-stage operation. In order to perform the two-stage operation with the switch device according to the related art, a position at which the switch operation parts 105 and 117 are pressed is eccentrically disposed from the idle position between the two rubber domes so as to make different distances from the rubber domes 119 to each operation part, whereby the first and second-stage operation is performed. However, since the rubber domes 119 have the same shape, it is very difficult for the rubber domes to correspond to various application force.

SUMMARY OF THE INVENTION

The present invention has been finalized in view of the drawbacks inherent in the switch device according to the related art, and it is an object of the present invention to provide a switch device which has rubber domes generating superior click feelings, in a two-stage click which smoothly corresponds to various application forces.

According to an aspect of the invention, a switch device includes a rubber dome for small application force, a rubber dome for heavy application force, and an operation body. The rubber domes made of a rubber material are integrally formed with one plate shaped base, respectively and are adjacent to each other. The operation body is disposed on the rubber domes such that one lower end of the operation body is disposed on the top surface of the rubber dome for small application force and the other lower end is disposed on the top surface of the rubber dome for heavy application force. The operation body is movably supported in a vertical direction. The base around the rubber dome for heavy application force is formed with a smaller thickness than the base around the rubber dome for small application force, and a preventing part is provided so as to prevent the base of the rubber dome for small application force from deforming. The thick base around the rubber dome for heavy application force and the preventing part are disposed so as to surround an outer periphery of the base of the rubber dome for small application force.

In the switch according to another aspect of the invention, four rubber domes are provided to correspond to one seesaw switch, and the four rubber domes are disposed such that the rubber dome for small application force and the rubber dome for heavy application force are diagonally arranged.

In the switch according to another aspect of the invention, the preventing part, for preventing the base of the rubber dome for small application force from deforming, is formed such that the preventing part is in contact with an internal wall face of a switch case of the switch device and sides of the base.

In the invention, since the outer periphery of the base to be affected by pressing the rubber dome for small application force is prevented from unnecessarily bending by the base of the rubber dome for heavy application force and the preventing part, the rubber dome for small application force is normally buckling, so that clear click feelings can be obtained. Further, since the base of the rubber dome for heavy application force can replace the preventing part, the preventing part for deformation does not need to be separately disposed in the base, which makes it possible to lessen the dimensions and even to simplify the structure. Further, since deformation can be prevented by using the switch case having high rigidity, in a region where the base around the rubber dome for heavy application force cannot be used as a preventing part for deformation, the switch case can be made smaller, compared to the switch case having the preventing part disposed in the click rubber.

Even though the rubber dome for small application force can be prevented from deforming by making thick the base of the rubber dome for heavy application force, click feelings do not deteriorate, because the base around the rubber dome for heavy application force is thick so that the base can be prevented from deforming.

In this way, it is possible to make smaller and simpler switches for small application force and heavy application force, and generate clear click feelings.

In the invention, since the rubber dome for small application force and the rubber dome for heavy application force are diagonally arranged, it is possible to make the best use of the base of the rubber dome for heavy application force.

In the invention, when heavily pressing the click rubber so as to prevent deformation, the amount of deformation of the base depends on differences of pressed loads on the base, which may cause different click feelings. However, since the preventing part is in contact with the internal wall face of the switch case and the side of the base, the amount of deformation of the base never changes, thereby ensuring stable click feelings.

DESCRIPTION OF THE PREFERRED EMBODIMENT

Hereinafter, a preferred embodiment of the present invention will now be described with reference to the drawings.

Figure 1:
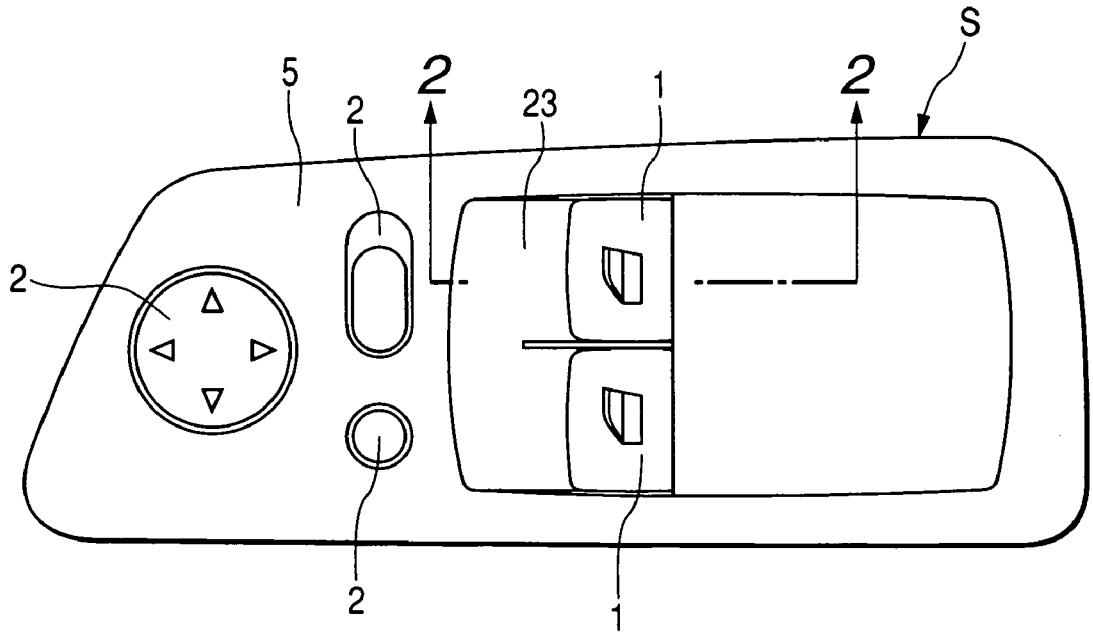
FIG. 1 is a plan view of a power window switch device to which a switch device according to an embodiment of the invention is applied.
Figure 2:
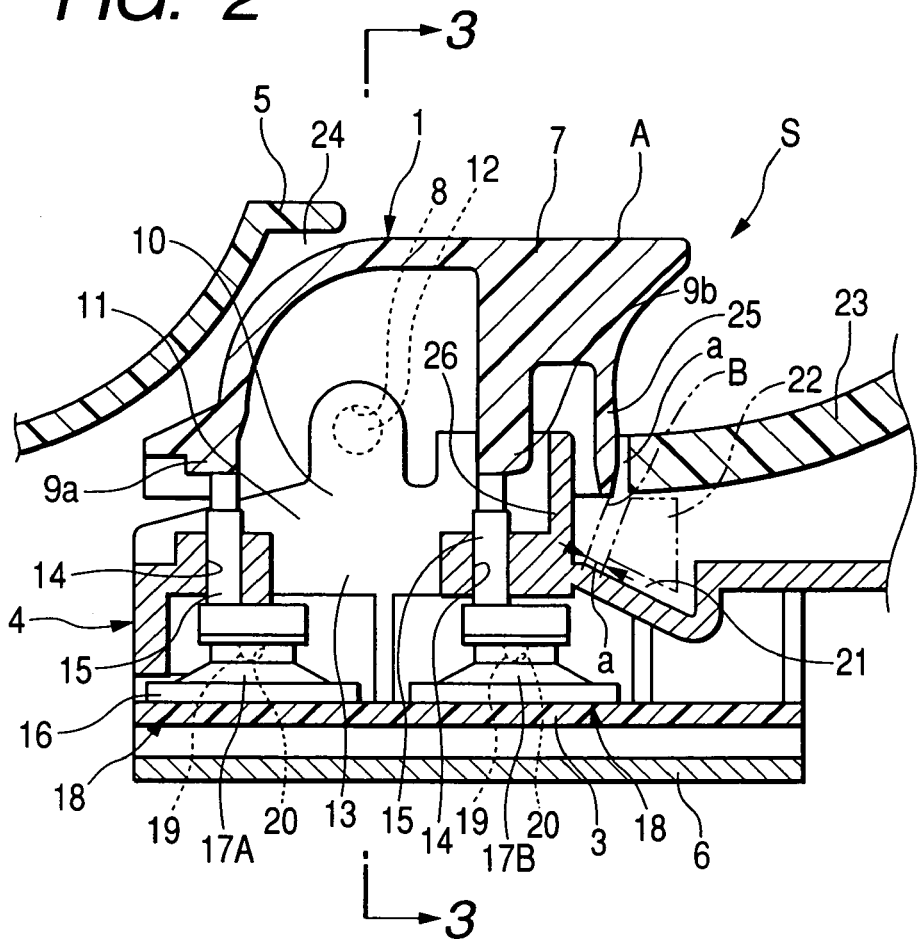
FIG. 2 is a cross-sectional view of the power window switch device taken from the line 2—2 of FIG. 1.
Figure 3:
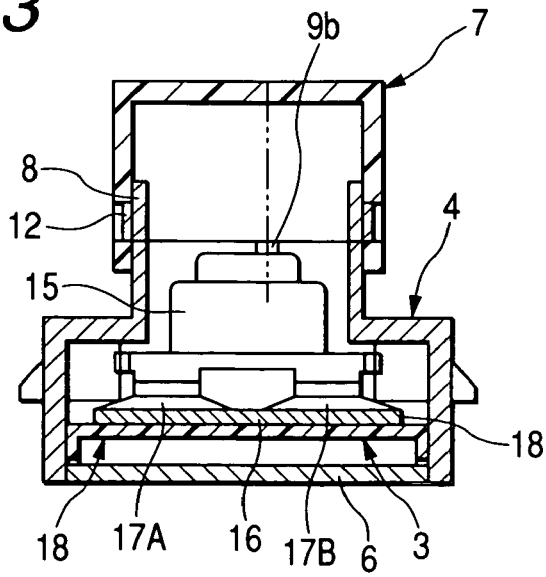
FIG. 3 is a cross-sectional view of the power window switch device taken from the line 3—3 of FIG. 1.
Figure 4:
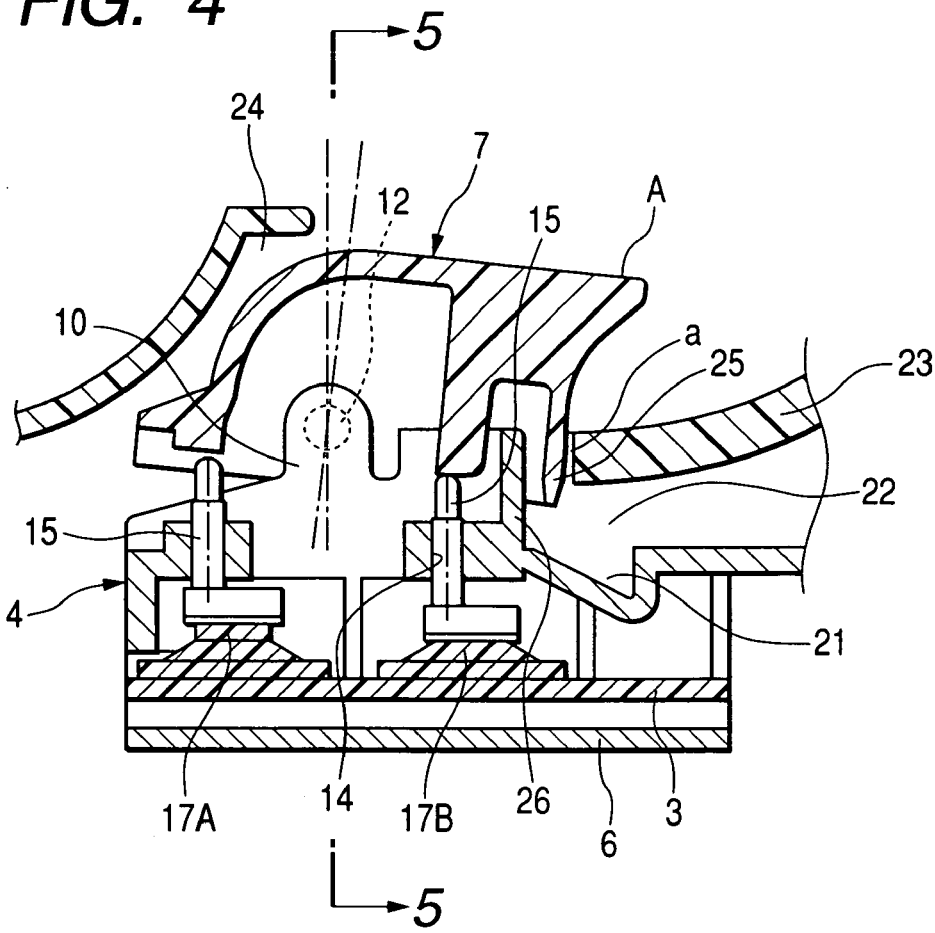
FIG. 4 is a cross-sectional view showing a state in which the power window switch device is pressed.
Figure 5:
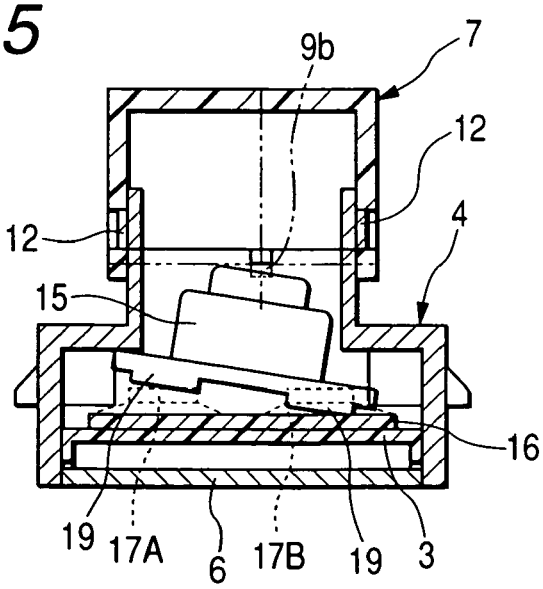
FIG. 5 is a cross-sectional view of the power window switch device taken from the line 5—5 of FIG. 4.
Figure 6:
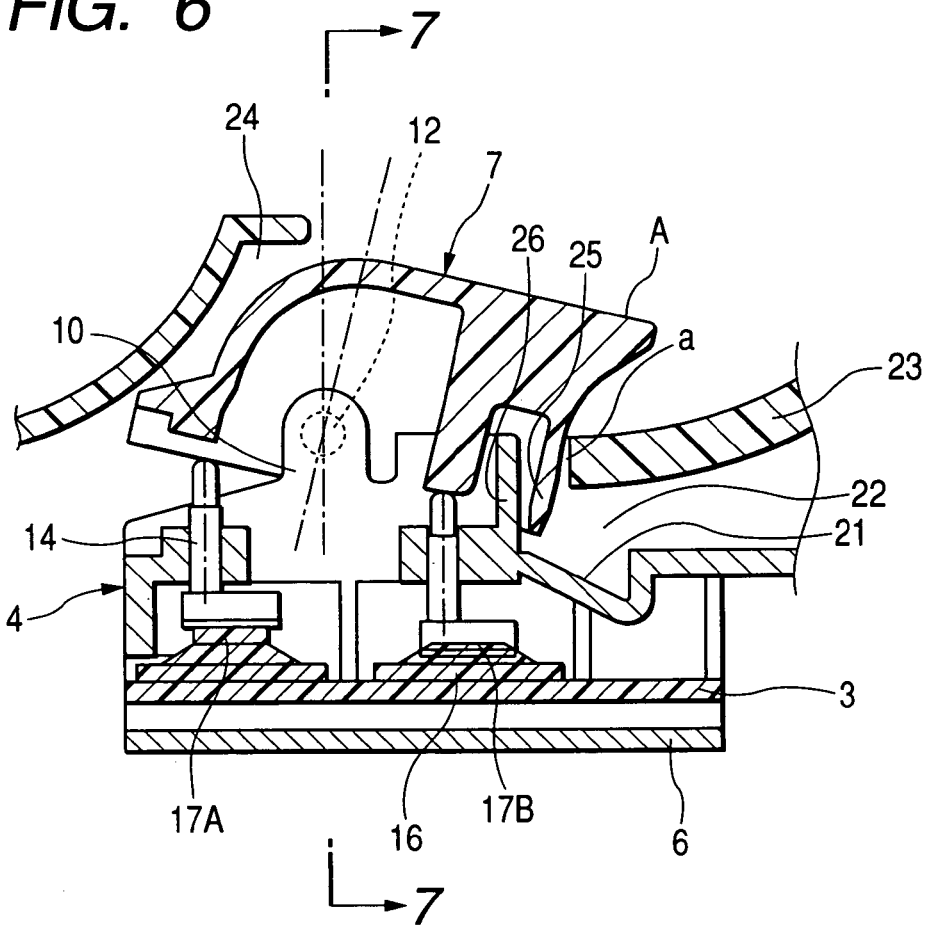
FIG. 6 is a cross-sectional view showing a state in which the power window switch device is further pressed.
Figure 7:
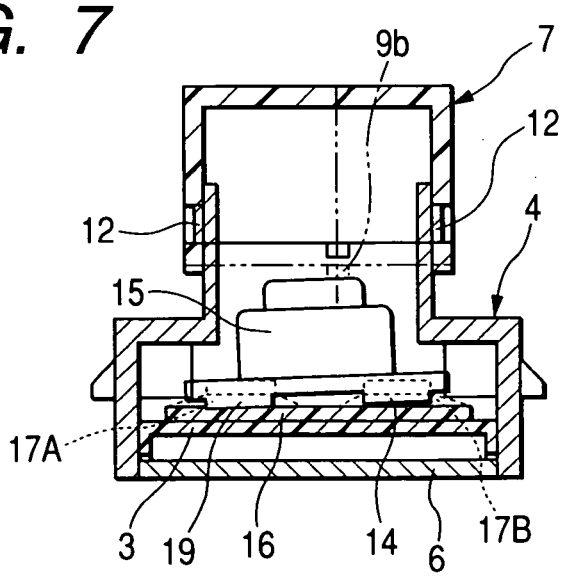
FIG. 7 is a cross-sectional view of the power window switch device taken from the line 7—7 of FIG. 6.
Figure 8:
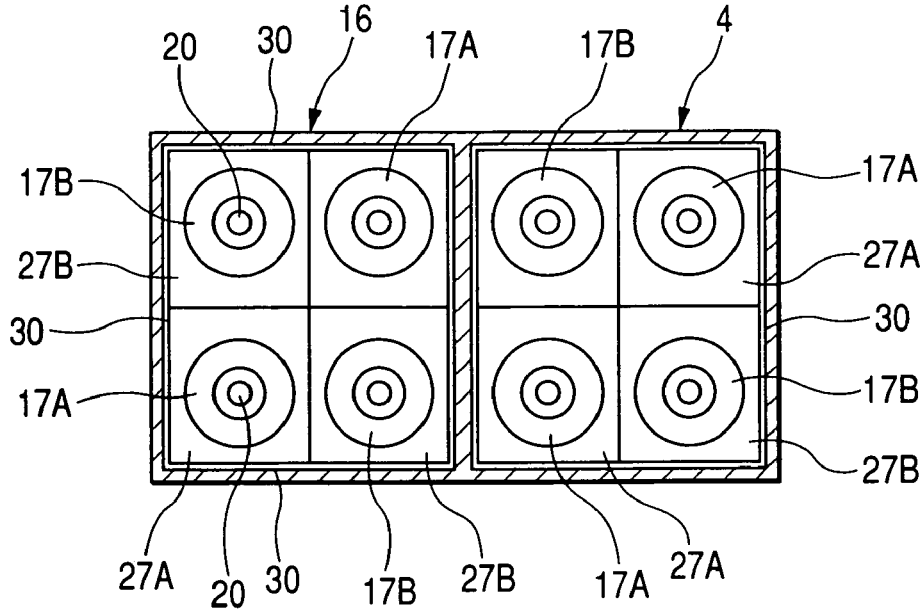
FIG. 8 is a cross-sectional view of a click rubber accommodated in a switch case.
Figure 9:
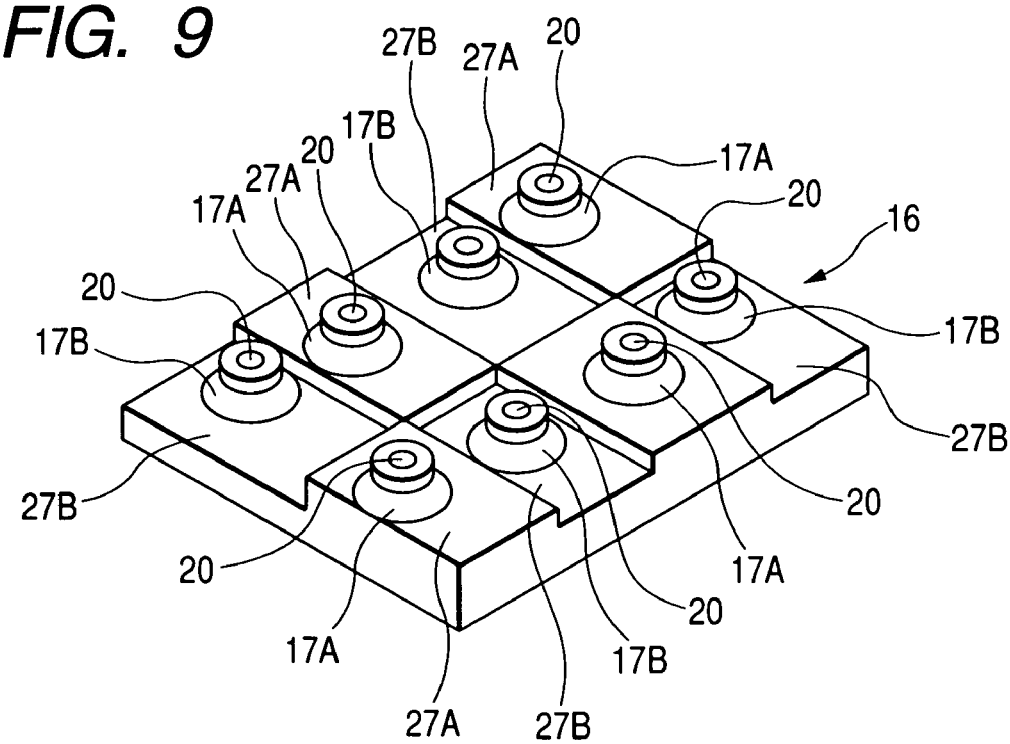
FIG. 9 is a perspective view of the click rubber.
Figure 10:
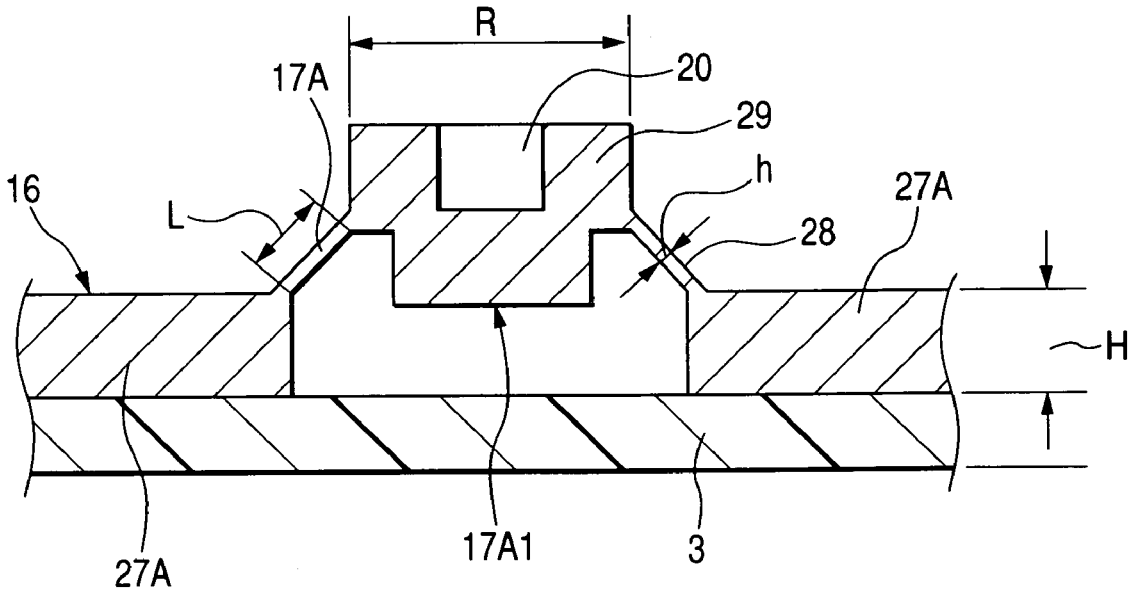
FIG. 10 is an explanatory view showing the dimensional relationship of a rubber dome of a click rubber.
Figure 11:
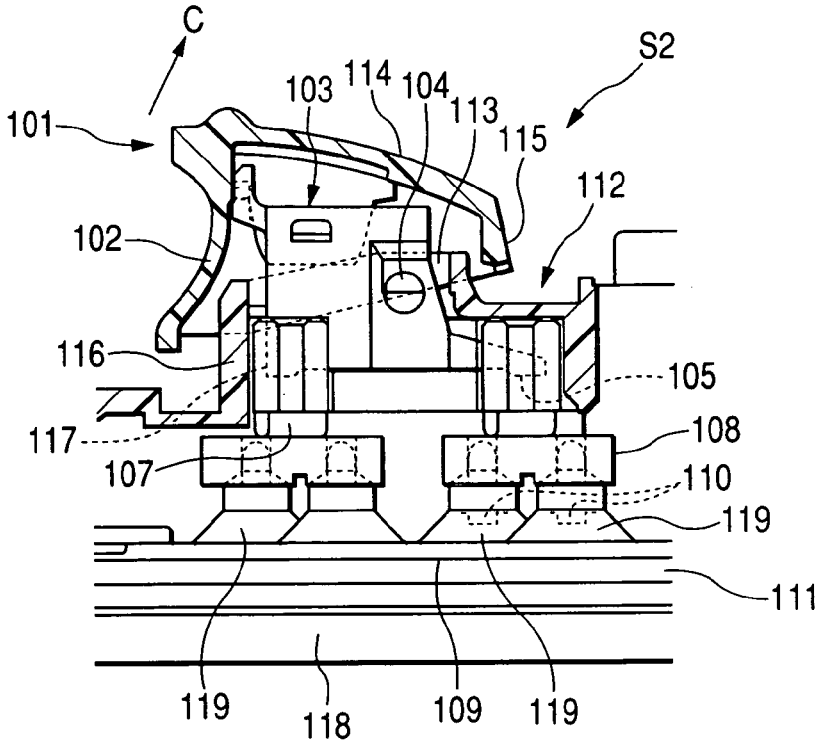
FIG. 11 PRIOR ART
FIG. 11 is a cross-sectional view of a switch device according to the related art.
Figure 12:
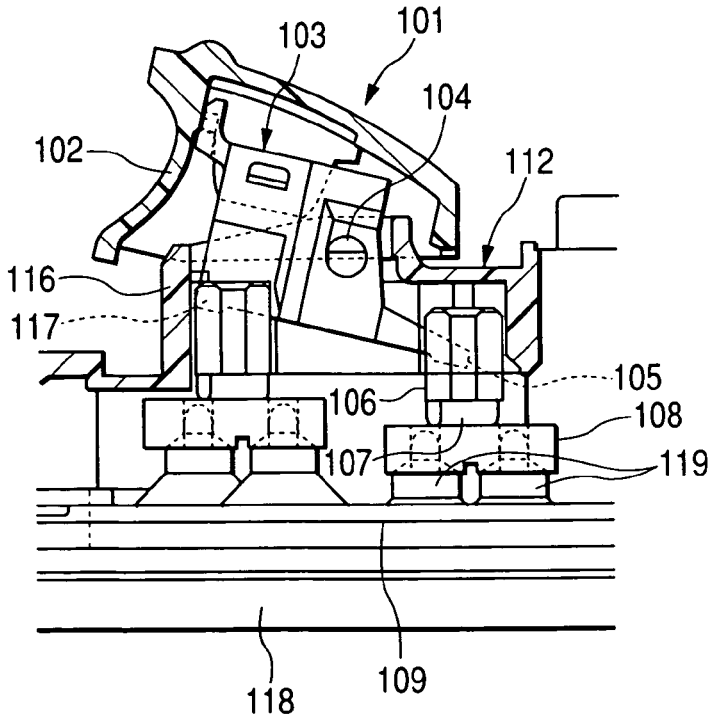
FIG. 12 PRIOR ART
FIG. 12 is a cross-sectional view showing a state after the switch device of FIG. 11 is operated.

FIG. 1 is a plan view of a power window switch device to which a switch device according to the embodiment of the invention is applied; FIG. 2 is a cross-sectional view of the power window switch device taken from the line 2—2 of FIG. 1; FIG. 3 is a cross-sectional view of the power window switch device taken from the line 3—3 of FIG. 1; FIG. 4 is a cross-sectional view showing a state in which the power window switch device is pressed; FIG. 5 is a cross-sectional view of the power window switch device taken from the line 5—5 of FIG. 4; FIG. 6 is a cross-sectional view showing a state in which the power window switch device is further pressed; FIG. 7 is a cross-sectional view of the power window switch device taken from the line 7—7 of FIG. 6; FIG. 8 is a cross-sectional view of a click rubber accommodated in a switch case; FIG. 9 is a perspective view of the click rubber; and FIG. 10 is an explanatory view showing the dimensional relationship of a rubber dome of a click rubber.

Next, the constitution of the switch device according to the embodiment of the invention will be described with reference to FIGS. 1 to 10.

A switch device S is deposed on sides of a door on the driver's side for the driver's convenience in operating the switch device, and four seesaw switches 1 serving as power window switches are disposed individually corresponding to respective windows for opening/closing windows of respective seats. Since the four seesaw switches basically share one structure, only two of them are illustrated. Switches indicated by 2 are other operation switches.

As shown in FIG. 2, the switch device S has a circuit board 3 having a plurality of sets of fixed contacts (not shown), a switch case 4 is mounted on the circuit board 3, and the switch case 4 is provided with a panel 5 thereabove and with the switch case 4 therebelow, respectively, so as to form a basic structure. The seesaw switch 1 is mounted on the basic structure.

Next, the constitution of the seesaw switch 1 will be described.

Reference numeral 7 indicates a seesaw finger grip having a case shape whose bottom is opened, a pair of shaft support holes 8 are formed at a lower portion of both side plates of the seesaw finger grip 7. Both sides of the shaft support hole 8 are provided with switch operation parts 9*a* and 9*b*. On the left side of the shaft support hole 8, a protrusion, which is protrudingly formed on a lower end surface of a left side wall in FIG. 2, serves as the switch operation part 9*a*. On the right side of the shaft support hole 8, a protrusion, which is protrudingly formed on a lower surface of a wall drawn to the right in FIG. 2, serves as the switch operation part 9*b*.

The switch case 4 is surrounded by an ascent wall part 10 so that an aperture 11 is formed. A pair of shaft support protrusions 12 is integrally formed at both sides of the ascent wall part 11 to be inserted in the shaft support hole 8. Both side plates and the ascent wall part 10 of the seesaw finger grip 7 made of synthetic resin bend, so that the seesaw finger grip 7 is swingably mounted on the switch case 4. An insertion through hole 13 is disposed in a lower portion inside the aperture 11. A guide hole 14 is formed on an upper plate of the switch case 4, and an operation body 15 is inserted in the guide hole 14 so as to be vertically movable therein. Lower ends of these operation bodies 15 are in contact with rubber domes 17A and 17B of the click dome 16. An upper end of one of the operation bodies 15 is in contact with a switch operation part 9*b* of the seesaw finger grip 7, and an upper end of the other operation body 15 is in contact with a switch operation part 9*b* of the seesaw finger grip 7. To be described later, the rubber dome 17A is a rubber dome which needs a heavy application force, the rubber dome 17B is a rubber dome which can generate click feelings with a small application force.

The click rubber 16 is electrically conductive to the rubber domes 17A and 17B, respectively, is provided with a movable contact 17A1 facing the fixed contact, so that a push switch 18 is formed by these fixed contacts and movable contacts. Both lower ends of the operation body 15 are provided with protrusions 19 protruding therefrom, these protrusions 19 are individually fitted in fitting concavities 20 provided on a upper surface of the rubber domes 17A and 17B of the click rubber 16. Two push switches 18 are provided for each operation body 15. As shown in FIG. 3, the switch operation parts 9*a* and 9*b* abutting the upper ends of the operation bodies 15 are disposed in a position closer to the right push switch 18 (rubber dome 17B) rather than in a middle position between both push switches 18 (rubber domes 17A and 17B). With this structure, a two-stage switch operation is performed while generating two-stage click feelings, as to be described later. A rectangular base 27A (from the top view) is formed around the rubber dome 17A for heavy application force, and the base 27A is formed thicker than a base 27B formed around the rubber dome 17B for small application force. As shown in FIG. 9, the rubber dome 17A for heavy application force and the rubber dome 17B for small application force are adjacently disposed to the plate shaped base 27A and 27B and alternately disposed on the click rubber 16.

An upper part of one end in a formation direction of the seesaw finger grip 7 is a contacted part A where a finger contacts the seesaw finger grip 7. A tapered part 21 is disposed in a direction away from the seesaw finger grip 7, over at least the range of a gap a, so as to face the contacted part A and to decline as it goes away from the seesaw finger grip 7. A space 22 is provided above the tapered part 21.

The panel 5 covers the switch case 4 so as to have a cosmetic surface, a concave wall part 23 is formed in an arc, and a storage opening 24 is formed opened. The seesaw finger grip 7 is disposed in the storage opening 24 of the panel 5, a left end edge of the arc shaped concave wall part 23 is disposed to face a right outside wall face 25 (in FIG. 2) of the seesaw finger grip 7 with a gap a. The seesaw finger grip 7 swings about the shaft support hole 8 and the shaft support protrusion 12. Therefore, when the seesaw finger grip 7 is pressed at the contacted part A, the seesaw finger grip 7 swings in a clockwise direction about the shaft support hole 8 and the shaft support protrusion 12, the right outside wall face 25 swings along a locus B indicated by a one-dot chain line.

When the seesaw finger grip 7 is pressed, the right outside wall face 25 of the seesaw finger grip 7 abuts a right wall part 26 of the switch case 4, so that the right wall part 26 functions as a stopper for the seesaw finger grip 7, the tapered part 21 is continuously formed to the stopper.

These tapered parts 21 and spaces 22 are provided in the formation direction of the seesaw finger grip 7, that is, in a transverse direction of FIG. 2. With this structure, a plurality of seesaw switches 1 functioning as a switch for driving power windows can be compactly arranged in a direction (orthogonal to the page of FIG. 2) orthogonal to the formation direction of the seesaw finger grip 7.

First, the two-stage switch operation according to the present embodiment will be described.

In a non operation state, as shown in FIGS. 2 and 3, when an operator presses the seesaw finger grip 7 at the right upper side (in FIG. 2) of the seesaw finger grip 7, since the seesaw finger grip 7 is swingably supported about the shaft support hole 8 and the shaft support protrusion 12, the seesaw finger grip 7 swings in the clockwise direction of FIG. 2 about the shaft support protrusion 12, the pressed side (right side) of the seesaw finger grip 7 descends. Operation force applied on the seesaw finger grip 7 presses down the operation body 15 through the switch operation part 9*b* disposed at the rear side of the seesaw finger grip 7, and then is transmitted to the right and left rubber domes 17A and 17B (in FIG. 3) of the click rubber 16 (in FIG. 3). Since the switch operation part 9*b* is located in a position closer to the right rubber dome 17B (in FIG. 3) than to the left rubber dome 17A, if distances from the switch operation part 9*b* to the rubber domes 17A and 17B are the same, the right rubber dome 17B can be operated by only small load, so that the right rubber dome 17B first starts buckling deformation. As shown in FIGS. 4 and 5, at a time point when the seesaw finger grip 7 slightly swings, for example, in the clockwise direction in FIG. 4, the right rubber dome 17B (in FIG. 5) is buckling-deformed by pressing the seesaw finger grip 7 and thus generates click feelings, and the movable contacts (not shown) disposed in the rubber dome 17B are brought into contact with the fixed contacts (not shown) facing the movable contacts, so that the corresponding fixed contact is made electrically continuous via the movable contact. Therefore, the corresponding push switch 18 outputs a first-stage electric signal according to the swinging of the seesaw finger grip 7.

When the seesaw finger grip 7 is further pressed in the state shown in FIGS. 4 and 5, since the deformation of the right rubber dome 17B has been finished, the operation body 15 swings in a counter-clockwise direction of FIG. 5 about the right rubber dome 17B for small application force as a fulcrum, a sufficient force is applied on the left rubber dome 17A in FIG. 5. As shown in FIGS. 6 and 7, when the corresponding seesaw finger grip 7 further swings, the left rubber dome 17A in FIG. 7 is buckling-deformed and thus a second click feeling is generated, and the movable contacts (not shown) disposed in the rubber dome 17A are brought into contact with the fixed contacts (not shown) facing the movable contacts, and the corresponding fixed contact becomes conducting (on) by way of the movable contact. Therefore, the push switch 18 outputs a second-stage electric signal according to the swinging of the seesaw finger grip 7. The rubber dome 17A for generating a second-stage click feeling may be operated with a heavy application force.

If the tilted seesaw finger grip 7 is released from a finger, resilient force of the pair of rubber domes 17A and 17B pushes the tilted side of the seesaw finger grip 7 up by way of the operation body 9*b*, the seesaw finger grip 7 returns to the non operation state shown in FIGS. 2 and 3. At this time, the movable contacts in contact with the fixed contacts are respectively separated from the fixed contacts, so as to return the set of two push switches 18 to a non conducting state (off).

When an operator pulls down the right end of the seesaw finger grip 7 which is in the non operation state shown in FIGS. 2 and 3, the corresponding seesaw finger grip 7 swings in the counter-clockwise direction of FIG. 2 so as to press the switch operation part 9*a*. In the same manner as pressing the switch operation part 9*b*, the set of two push switches 18 output first and second electric signals corresponding to swing angles.

Therefore, two operation bodies 15 operate with respect to one seesaw finger grip 7, two rubber domes 17A and 17B face one operation body 15, and all the four rubber domes 17A and 17B shown in FIGS. 8 and 9 are operated by one seesaw finger grip 7.

Next, the operation of the tapered part 21 and the space 22 will be described.

In the non operation state of FIG. 2, the gap a is provided between the right outside wall face 25 of the seesaw finger grip 7 and the end edge of the concave wall part 23 of the panel 5. Therefore, even though extraneous materials, such as a small stone sand on the arc shaped concave wall part 23 of the panel 5, extraneous materials having a larger size than the gap a are prevented from intruding thereinto. However, when an extraneous material is smaller than the gap a, the extraneous material intrudes into the gap a and drops on the tapered part 21 disposed below the gap a, and slips and falls to the right (in FIG. 2) due to the inclination of the tapered part 21. The tapered part 21 is disposed over at least the length of the gap a, from a swing locus B of the right outside wall face 25, and the space 22 having extraneous materials therein, forming the tapered part 21, is disposed above the tapered part 21. Therefore, the dropped extraneous materials are smoothly ejected from the swing locus B of the right outside wall face 25 of the seesaw finger grip 7, as shown in FIG. 6, the extraneous materials do not hinder the operation of pressing the seesaw finger grip 7 to the lowest position. Accordingly, it is possible to reliably output the first and second electric signals.

A taper groove may be formed continuous to the tapered part 21 so as to reach the end of the switch case 4. With this structure, extraneous materials continuously intrude into the gap a, since the extraneous materials of the tapered part 21 are ejected through the taper groove continuously formed to the tapered part 21, the next extraneous materials intruding thereinto are also ejected through the taper groove from the tapered part 21. Accordingly, the seesaw finger grip 7 is not hindered by the intruding extraneous materials, the seesaw finger grip 7 can keep the swing operation at the end device thereof, so that it is possible to output the first and second electric signals.

The tapered part 21 also functions as a container containing extraneous materials. Moreover, the tapered part 21 also has a function of drawing out water. Even though the tapered part 21 is replaced by a flat part (without inclination), when an extraneous material consists of a small stone or water, there is no fear that the stroke of the seesaw finger grip 7 is changed. However, when the water is evaporated leaving the small stone alone, or when the extraneous material is initially a small stone alone, if the tapered part 21 is replaced by a flat part, the extraneous material may stay on the surface of the flat part and become hindrance, so that the stroke of the seesaw finger grip 7 may be changed. For this reason, the tapered part has inclination in the invention.

The range in which the tapered part 21 is formed is set from a position corresponding to a neutral position of the seesaw finger grip 7 to a position corresponding to the gap a which becomes the largest by pushing and pulling the seesaw finger grip 7 from the neutral position. Therefore, with any operation of the seesaw finger grip 7, the above-described effect can be achieved. For example, in terms of operating position, if the gap a is made small, the shape of the seesaw finger grip 7 has limitation. On the other hand, by changing the range in which the tapered part 21 is formed, extraneous materials can be prevented from affecting the operation of the seesaw finger grip.

In the above-described present embodiment, the rubber dome 17B for small application force is prevented from unnecessarily bending in the two-stage click operation. However, hereinafter, characterizing parts of the invention will be described in detail.

First, the dimension of the rubber domes 17A and 17B according to the embodiment and the relationship between the heavy application force and the small application force will be described.

When the rubber domes 17A and 17B are pressed down, the rubber domes 17A and 17B are pressed and deformed against resilient force of rubber, and then buckled so as to generate click feelings. At this time, application force varies according to the thickness of the rubber domes.

FIG. 10 is a cross-sectional view of the rubber dome 17A(17B), reference numeral H indicates the thickness of the base 27A(17B), reference numeral h indicates the thickness of a conical part 28 of the rubber dome 17A, reference numeral L indicates the length (span) of the conical part 28 of the rubber dome 17A, and reference numeral R indicates a diameter of a head part 29 of the rubber dome 17A.

The rubber dome 17A for heavy application force has a diameter R larger than the rubber dome 17B for small application force. In the present embodiment, the rubber domes 17A and 17B have the same diameter of the root portion thereof, which makes short the span L contributed to the application force as a folded part of the dome (the conical part 28) during buckling. Therefore, the application force of the rubber dome increases.

The rubber dome 17A for heavy application force has a slightly thick thickness h of the conical part 28. When the rubber dome is pressed, the dome part is buckling-deformed. At this time, even though the base 27A which is provided around the rubber dome and continuous to the root portion of the rubber dome is deformed so as to widen to the outside, the root portion of the rubber dome can be prevented from spreading by making thick the thickness H of the base 27A so as to deform only the dome portion thereof. Therefore, heavy application can be facilitated, and the click feelings can be smooth.

Next, the click rubber will be described.

As shown in FIGS. 8 and 9, the click rubber 16 is formed such that the rubber dome 17A for heavy application force and the rubber dome 17B for small application force are alternately disposed. The rubber dome 17A for heavy application force especially has the thick base 27A therearound, and the rubber dome 17B for small application force has the base 27B therearound which is thicker than the base 27A. That is, the side of the base 27A of the rubber dome 17A for heavy application force faces the side of the rectangular base 27B of the rubber dome 17B for small application force. Therefore, three sides or two adjacent sides of the base 27B of the rubber dome 17B for small application force face the thick base 27A of the rubber dome 17A for heavy application force.

As shown in FIG. 8, the click rubber 16 is accommodated in a switch case 5, the peripheral edge of the click rubber 16 is in contact with an internal wall face 30 of the switch case 5, the internal wall face 30 functions as a preventing part that prevents the base 27B of the rubber dome 17B for small operation force from deforming.

Since the rubber dome 17B for small application force is regulated such that an outer periphery of the base 27B is prevented from unnecessarily bending by the thick base 27A of the rubber dome 17A for heavy application force or the internal wall face 30 of the switch case 5, the rubber dome 17B can generate clear click feelings.

The base 27A of the rubber dome 17A for heavy application force can replace the preventing part in a region where a preventing part is not provided, by providing a connection member disposed in the switch case 5. Accordingly, replacing the preventing part with the base makes it possible to lessen the dimensions and even to simplify the structure, compared to separately providing a preventing part for deformation in the base. Further, since the base 27B of the rubber dome 17B for small application force can be prevented from deforming by using a switch case 5 having high rigidity, in a region where the connection member is not disturbed, the switch case can be made smaller, compared to a switch case having the preventing part disposed in the click rubber 16.

In the present embodiment, the internal wall face 30 is in contact with the entire periphery of the click rubber 16 so as to function as a preventing part and to regulate the movement of the base 27B in a face direction caused by pressing the rubber dome 17B. However, the application of the present invention is not limited to this structure. In other words, the entire periphery of the click rubber 16 does not need to be regulated by the preventing part. For example, when the thick base 27A or a preventing part is provided in a region facing the outer periphery of the base 27B, the base 27B is prevented from deforming toward the thick base 27*a* or the preventing part, which may achieve the above-described effect. To be more specific, for example, two sides facing the click rubber 16 do not need to be disposed in contact with the internal wall face 30 at least when the base 27B is rectangular. This is because a pair of facing sides of the base 27B is provided with the thick base 27A or the preventing part (the internal wall face 30 in contact). This effect can be achieved as well when the external periphery is circular.

In the present embodiment, the operation body 15 is designed to swing by pressing down the seesaw finger grip 7. However, the application of the invention is not limited to the above-described embodiment. For example, the guide hole 14 is formed such that the operation body 15 moves only in a vertical direction without inclination, the switch is pressed while varying stroke until a load is applied on the rubber dome. In this way, since the operation body 15 is vertically pressed, it is difficult to apply a load on the rubber domes 17A and 17B in an oblique direction, thereby preventing damage.

In the present embodiment having the above-described structure, since the outer periphery of the base 27B of the rubber dome 17B for small application force is prevented from unnecessarily bending by the thick base 27A of the rubber dome 17A for heavy application force and the internal wall face 30 of the switch case 5, the rubber dome 17B for small application force can generate clear click feelings. Further, since the base 27A of the rubber dome 17A for heavy application force can replace the preventing part, the preventing part for deformation does not need to be separately disposed in the base, which makes it possible to lessen the dimensions and even to simplify the structure. Further, since deformation can be prevented by using the switch case 5 having high rigidity, the switch case can be made smaller, compared to the switch case having the preventing part disposed in the click rubber 16.

By making thick the base 27A of the rubber dome 17A for heavy application force, the base 27B of the rubber dome 17B for small application force can be prevented from deforming. This is possible because the rubber dome 17A for heavy application force is designed to bear with heavy application force.

Therefore, the rubber dome 17B (switch) for small application force and the rubber dome 17A (switch) for heavy application force can be formed into a simple and small structure, and generate clear click feelings.

In the present embodiment, since the rubber dome 17B for small application force and the rubber dome 17A for heavy application force are diagonally arranged, it is possible to make the best use of the base 27A of the rubber dome 17A for heavy application force in preventing the base 27B of the rubber dome 17B for small application force from deforming.

In the present embodiment, when the base is heavily pressed, the amount of deformation of the base depends on differences of pressed loads on the base, which may cause different click feelings. However, since the preventing part is in contact with the internal wall face 30 of the switch case 5 and the side of the base 27B, the amount of deformation of the base never changes, thereby ensuring stable click feelings.

The invention claimed is:

1. A switch device comprising:

a rubber dome for small application force and a rubber dome for heavy application force, respectively, made of a rubber material, which are integrally formed with one plate shaped base, respectively, the rubber domes being adjacent to each other; and;

operation body disposed on the rubber domes such that one lower end of the operation body is disposed on a top surface of the rubber dome for small application force and another lower end is disposed on a top surface of the rubber dome for heavy application force, the operation body being movably supported in a vertical direction, wherein the base around the rubber dome for heavy application force is thicker than the base around the rubber dome for small application force, and a preventing part is provided so as to prevent the base of the rubber dome for small application force from deforming, and the thick base around the rubber dome for heavy application force and the preventing part are disposed so as to surround an outer periphery of the base of the rubber dome for small application force.

2. The switch device according to claim 1, wherein four rubber domes are provided so as to correspond to one seesaw switch, the four rubber domes are disposed such that the rubber dome for small application force and the rubber dome for heavy application force are diagonally arranged.

3. The switch device according to claim 1, wherein the preventing part for preventing the base of the rubber dome for small application force from deforming is formed such that the preventing part is in contact with an internal wall face of a switch case of the switch device and sides of the base.

* * * * *